US005959533A

United States Patent [19]

Layson, Jr. et al.

[11] Patent Number: 5,959,533

[45] Date of Patent: Sep. 28, 1999

[54] TAMPER DETECTION FOR BODY WORN TRANSMITTER

[75] Inventors: Hoyt M. Layson, Jr.; David S. Segal, both of Palm Harbor; Peter Lefferson, St. Petersburg, all of Fla.

[73] Assignee: Pro Tech Monitoring, Inc., Palm Harbor, Fla.

[21] Appl. No.: 08/863,158

[22] Filed: May 27, 1997

[51] Int. Cl.[6] ..... G08B 23/00

[52] U.S. Cl. ..... 340/573.1; 340/573.4; 340/539; 340/825.54; 342/419

[58] Field of Search ..... 340/573.1, 573.4, 340/539, 825.54; 342/419

[56] References Cited

U.S. PATENT DOCUMENTS

| | | | |
|---|---|---|---|
| 4,812,823 | 3/1989 | Dickerson | 340/572 |
| 4,952,928 | 8/1990 | Carroll et al. | 340/573.1 |
| 4,980,671 | 12/1990 | McCurdy | 340/568 |
| 5,014,040 | 5/1991 | Weaver et al. | 340/572 |
| 5,204,670 | 4/1993 | Stinton | 340/825.54 |
| 5,298,884 | 3/1994 | Gilmore et al. | 340/573 |
| 5,461,390 | 10/1995 | Hoshen | 342/419 |
| 5,504,474 | 4/1996 | Libman et al. | 340/572 |
| 5,523,740 | 6/1996 | Burgmann | 340/573 |
| 5,650,766 | 7/1997 | Burgmann | 340/539 |
| 5,742,233 | 4/1998 | Hoffman et al. | 340/573 |

*Primary Examiner*—Jeffery A. Hofsass
*Assistant Examiner*—Tai Tan Nguyen
*Attorney, Agent, or Firm*—Larson & Larson, P.A.; James E. Larson

[57] ABSTRACT

A body worn transmitter and its associated portable monitoring receiver receiving global position signals, is provided with tamper detection to support twenty-four hour violation reporting from a subject under community supervision moves about the community. The body worn transmitter incorporates active radio frequency sensors to determine if the body worn transmitter has either been removed from the subject's body or the attachment strap has experienced tampering for the purpose of removal from the subject's body. A signal from the body worn transmitter is encrypted in order to prevent recording and retransmission of the body worn transmitter signal to an associated portable monitoring receiver for the purposes of masking body worn transmitter tampering or to make the body worn transmitter falsely appear in a different location. The body worn transmitter can be immersed in electrolyte solutions without generating a false tamper signal.

17 Claims, 9 Drawing Sheets

TAMPER DETECTION FOR BODY WORN TRANSMITTER

BACKGROUND OF THE INVENTION

1. Field of the Invention

This invention relates to body worn transmitters and methods for determining if tampering has occurred. More particularly, it refers to methods of detecting removal of a transmitter without inhibiting the subject's ability to perform his or her occupation.

2. Description of Prior Art

Body worn transmitters containing tamper detection elements are used today with a fixed position monitoring receiver for the purpose of house arrest, curfew sentencing, pre-trial sentencing, parole and probation. Today, tamper detection only can be reported while the body worn transmitter is communicating with an associated monitoring receiver in a fixed location. Recently, portable monitoring receivers for body worn transmitters determining location using radio triangulation have been designed to report the location of tampering with a body worn transmitter whenever and wherever such tampering occurs. The current house arrest tamper detection systems however, do not allow subjects to have occupations requiring them to be immersed in water above the body worn transmitter. Such immersion in water prevents operation of the transmitter to the associated monitoring receiver. Either being immersed in an electrolyte solution or not being able to communicate with the monitoring receiver due to immersion results in potentially false tampering reports.

Currently, determining tampering with a body worn transmitter is accomplished by using either embedded wires or fiber optics in a strap attached to the transmitter. The transmitter is attached with the strap either at the ankle or wrist of the subject. A continuity circuit through the strap using either wires or fiber optics detects if the attaching strap has been severed. There is a problem with each of the wires or fiber optics. In the case of continuity wires embedded in the strap, jumper wires can be used to circumvent the continuity circuit. In the case of fiber optics, clean and optically flat connection interfaces are difficult to achieve when cutting the strap for fitting around the ankle or wrist of the subject, thus requiring optical interface gels or oils which could leach out of the connectors from repeated immersion causing false tampering signals. These devices can be seen in U.S. Pat. Nos. 5,298,884, 5,523,740, 5,504,474, 4,980,671, 5,014,040, and 4,812,823.

Other systems to detect the close proximity of the subject to the transmitter employ a passive proximity circuit or electric potential detector requiring additional wires embedded in the strap to function as an anode and cathode. This system determines capacitance change with distance changes between the strap and the human body. Since the detector is passive and uses an amplifier for gain to measure capacitance of the human body, slight movements of the body worn device erroneously can register as tampering signals. Since the body is mostly comprised of salt water, immersion of proximity sensors in a saline solution masks the effects of removing the transmitter since the electrolytic nature of the saline solution exhibits the same capacitance as the human body. While immersed, the transmitter cannot radiate to the associated monitoring receiver because the transmitted signal is attenuated with the antenna immersed. For this reason, immersion in an electrolytic solution, such as a chlorine solution or brackish water will register as a tampering signal for the transmitter as described in U.S. Pat. No. 5,298,884.

A transmitted signal from the current body worn transmitters is capable of being recorded using a scanner and retransmitted using a signal generator in order to mislead the monitoring receiver. Such action would allow transmitter tampering to occur without detection by the monitoring receiver. Body worn transmitters need to latch when tampering is detected. If a notification of tampering is determined to be false, then a system to reset the tamper latch remotely is desired to remove the need to physically reset the tamper latch on the body transmitter.

There exists a need to improve detection of tampering with body worn transmitters. In addition, subjects wearing transmitters having occupations requiring physical activity generating sweat or immersed in electrolyte solutions above the body worn transmitter need to be protected from the generation of false tampering signals. In the case of a confirmed false tampering signal, there is a need for a system to reset the tamper latch as set forth above.

The integrity of the signal between the body worn transmitter and the monitoring receiver also needs to be improved to prevent misleading tamper detection signals generated by the body worn transmitter or masking of the tamper detection signal by the subject.

SUMMARY OF THE INVENTION

The tamper detection deficiencies of the prior art system is solved by the twenty-four hour monitoring system of this invention. A portable monitoring receiver is required to be carried by the subject wherever he or she moves in the community. An antenna is imbedded in a strap attached to the body worn transmitter continuously communicating with the portable monitoring receiver. A strap alarm electrically couples the antenna to the transmitter. The transmitter contains a program exhibiting a unique identification coded signal, data encryption for the coded signal, tamper detection using an antenna reflected power sensor and level detector, an antenna voltage standing wave ratio sensor and change detector and a transmitter cover pressure sensitive switch. In addition, there is an electrolyte immersion sensor sending a tamper inhibit signal via the antenna. A real-time clock in the body worn transmitter prevents masking the detection of tampering and provides a remote method of resetting the tamper latch.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
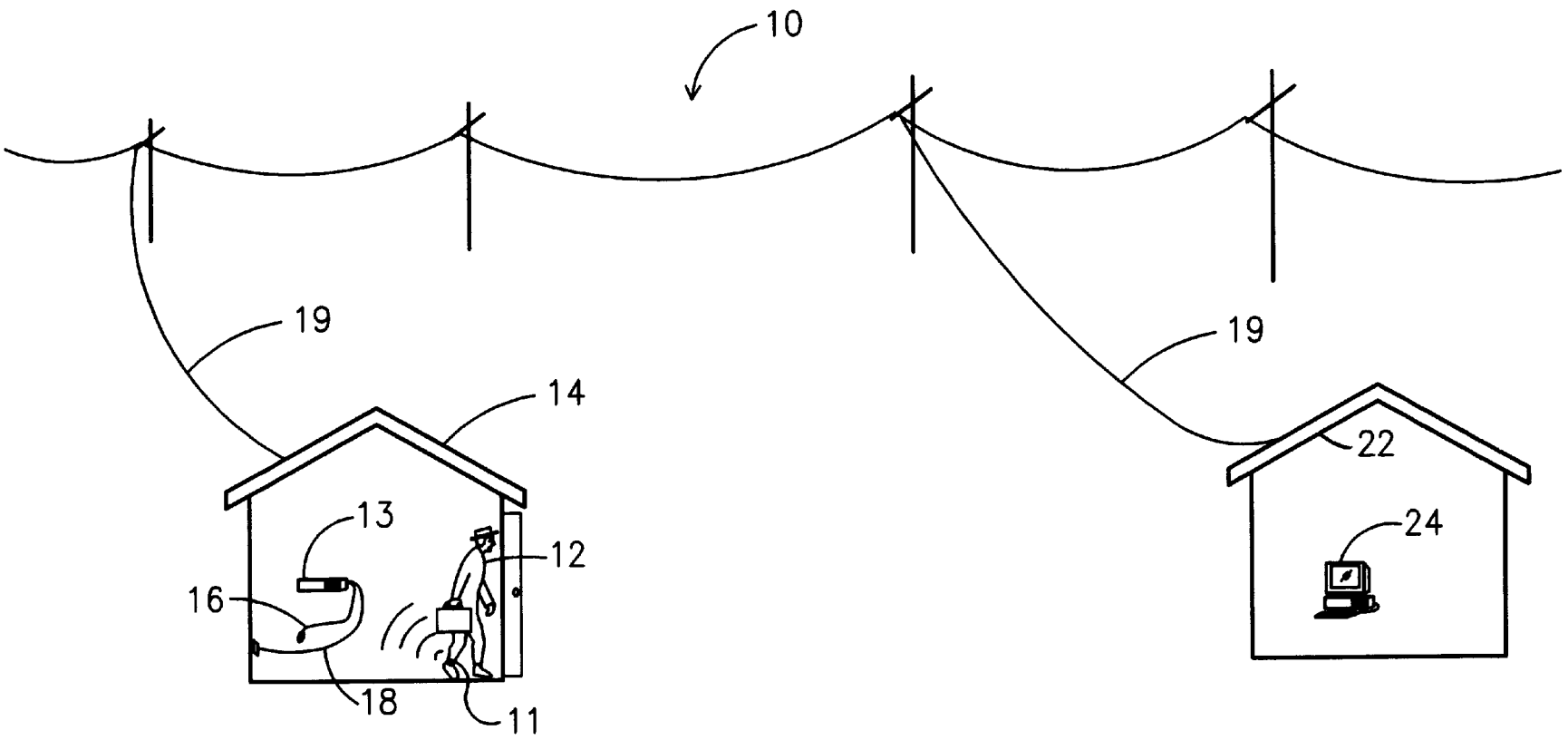
Fig. 1 PRIOR ART
FIG. 1 is a diagram of a prior art house arrest system including a body worn transmitter, a fixed location monitoring receiver at the offender's residence and monitoring center.

Throughout the following detailed description, the same reference numerals refer to the same elements in all figures.

FIG. 1 illustrates the prior art house arrest system 10 for a subject 12 incorporating a body worn transmitter 11 that communicates with a monitoring receiver 13 at the subject's residence 14 to determine when the subject is at the residence 14. When the subject 12 leaves the residence 14, the monitoring receiver 13 can no longer receive signals from the body worn transmitter 11 on the subject 12. The monitoring receiver 13, using house power 16 or internal batteries, generates a phone call via the house telephone line 18 through the public switched telephone network 19 to the monitoring center 22 where the host computer 24 compares the allowable departure times to the time of the call from the monitoring receiver 13 at the subject's residence 14.

Tamper detection in the prior art house arrest body worn transmitter 11 can only report tampering signals to the subject 12 and the monitoring center 22 while the transmitter 11 is within range of the fixed location monitoring receiver 13. Therefore, while the subject 12 is away from his or her residence 14, activities are not reported that would trigger tampering signals or a violation of the subject's schedule or location. This prior art system is subject to recording and retransmission known in the art as spoofing. This can either mask tampering with the transmission signal from the body worn transmitter 11 or make the transmitter 11 appear within range of the monitoring receiver when it is actually out of range.

Figure 2:
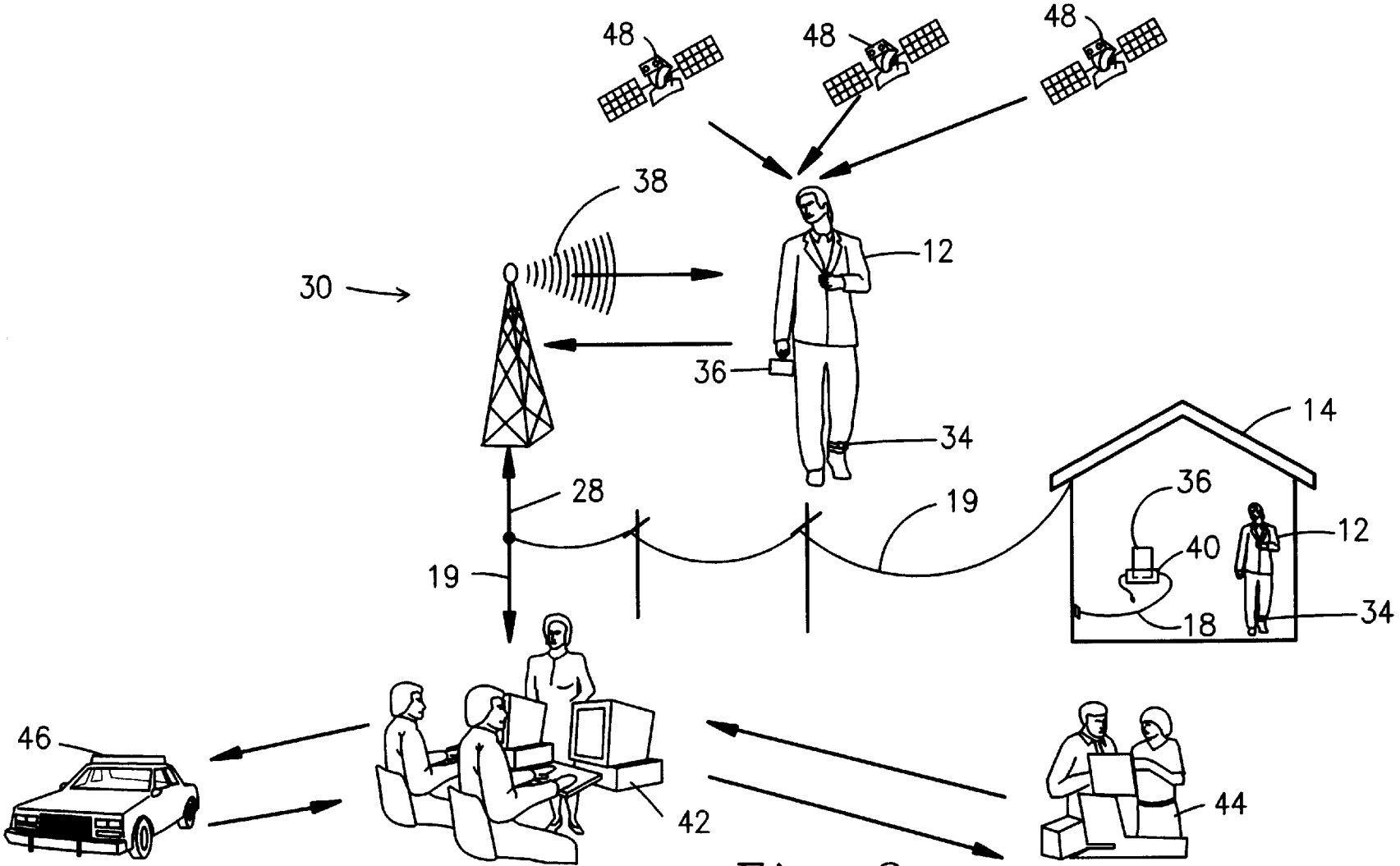
FIG. 2 is a diagram of a twenty-four hour portable locating system employed in this invention showing body worn transmitter, portable monitoring receiver and central data base.

FIG. 2 illustrates the twenty-four hour portable locating system 30 of this invention. The subject 12 has an improved body worn transmitter 34 communicating with a portable monitoring receiver 36 carried by the subject 12 from his or her residence 14 to allowed locations such as his her workplace. Since there is no hard line phone number to verify the location of the monitoring receiver 36, radio signal triangulation from satellites 48 is performed in the portable monitoring receiver 36 allowing the monitoring receiver to determine its location. Location information for the subject 12 as well as transmitter 34 and portable monitoring receiver 36 health and status information is reported using a wireless network 38 and the public switched telephone network 19 to a central monitoring facility 42 where a subject's movements can be recorded for real-time or historical processing. When the subject is at his or her residence 14, the twenty-four hour portable monitoring receiver 36 connects directly to the public switched telephone network 19 using the subject's residential telephone line 18 connected to the battery charging stand 40.

Community supervision sentencing guidelines for the subject are provided by the supervising criminal justice agency 44 which can review the subject's current or recorded location data for any violations. Law enforcement 46 also can review the subject's current or recorded location data and can be dispatched to the subject's current location for apprehension of the subject.

Key requirements for the proper operation of the portable system of this invention are that 1) tamper detection for the body worn transmitter 34 must be performed at all times in order to verify the integrity of the body worn transmitter 34 and 2) the radio signals between the body worn transmitter 34 and the monitoring receiver 36 must not be altered or mimicked to spoof the monitoring receiver 36. These requirements are essential in order to verify the subject's location while he or she move about the community.

Figure 3:
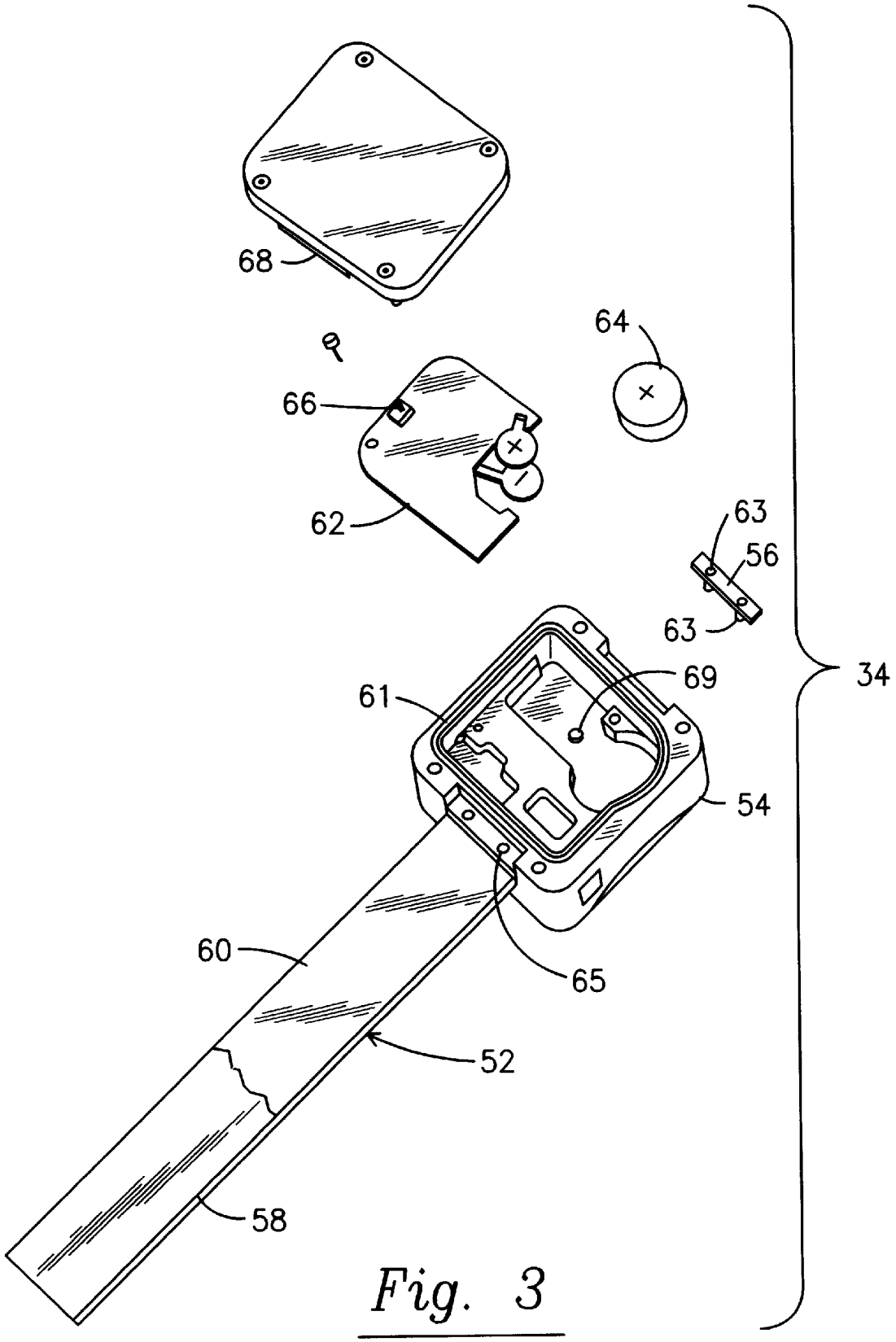
FIG. 3 is an exploded view of the body worn transmitter describing the strap antenna and body worn transmitter case.

FIG. 3 illustrates the twenty-four hour portable system body worn transmitter 34. The attaching strap 52 is cut to fit the subject's ankle and is locked to the transmitter housing 54 by strap clamps 56 at each end of the attaching strap 52. The inner core 58 of the attaching strap 52 is a corrosion resistant metal foil coated with a soft synthetic insulating material 60. The strap clamps 56 secure the body worn transmitter 34 to the subject's body. In addition the strap clamps 56 electrically connect the attachment strap inner core 58 which acts as an antenna to the transmitter electronic circuit board 62 using embedded wires in the transmitter case between the tapped threads 65 for the strap clamp screws 63 and the transmitter electronics circuit board 62. The attachment strap antenna 58 inductively couples the transmitted signal energy to the body of the subject. This method uses the body of the subject as the antenna for the body worn transmitter. The body worn transmitter circuit board 62 is powered by a replaceable battery 64. The body worn transmitter housing 54 has a pressure sensitive switch 66 to determine when the cover 68 is removed. A waterproof gasket 61 seals the cover 68 to the housing 54 of the body worn transmitter protecting the transmitter electronics. The cover 68, when attached, covers the access to the strap clamp screws 63 forming tamper detection for access to strap clamps 56. Since the strap clamps 56 electrically connect the antenna 58 to the transmitter circuit board 62, removal of the strap clamps 56 will generate a tampering signal when the transmitter circuit board 62 loses connection to the antenna 58.

When the body worn transmitter circuit board 62 is transmitting and the subject's body is functioning as an inductively coupled antenna through the inner core 58 of the attachment strap 52, radio power from the transmitter 34 is radiated by the antenna formed by the subject's body. The body of the subject becomes an antenna by the loop formed by the attachment strap antenna 58. This loop serves as a winding of a coil inducing transmitter power on the body of the subject. If the body worn transmitter 34 is removed from the body, the radio power from the transmitter 34 cannot be inductively transferred to the subject's body through the attaching strap antenna and is reflected back to the transmitter 34. The body worn bracelet circuitry shown in FIG. 4 detects changes to the antenna reflected radio power or the voltage standing wave ratio (VSWR).

By utilizing the human body as a radiator of radio energy with very low power, FCC approved transmitters operating below 500 MHz, any portion of the body not immersed in an electrolyte serves as an antenna for the body worn transmitter. This permits the body worn transmitter to remain in contact with the monitoring receiver. By embedding the transmitter antenna 58 in the attaching strap 52, the antenna must be altered in order to remove the body worn transmitter. Further, by measuring the reflected energy of the antenna coupling to the human body, any changes to the radio frequency characteristics of the antenna can be detected. Using a jumper wire to bridge a cut to the strap antenna or removing the transmitter from the body changes the antenna characteristics which will change the reflected energy of the antenna. Detecting changes to the reflected energy against a set threshold or changes to the ratio of transmitter power to the antenna reflected power will indicate tampering with the attachment strap. The ratio of transmitter power to reflected power is commonly called reflection coefficient (10*log (power reflected/power coupled)).

Figure 4:
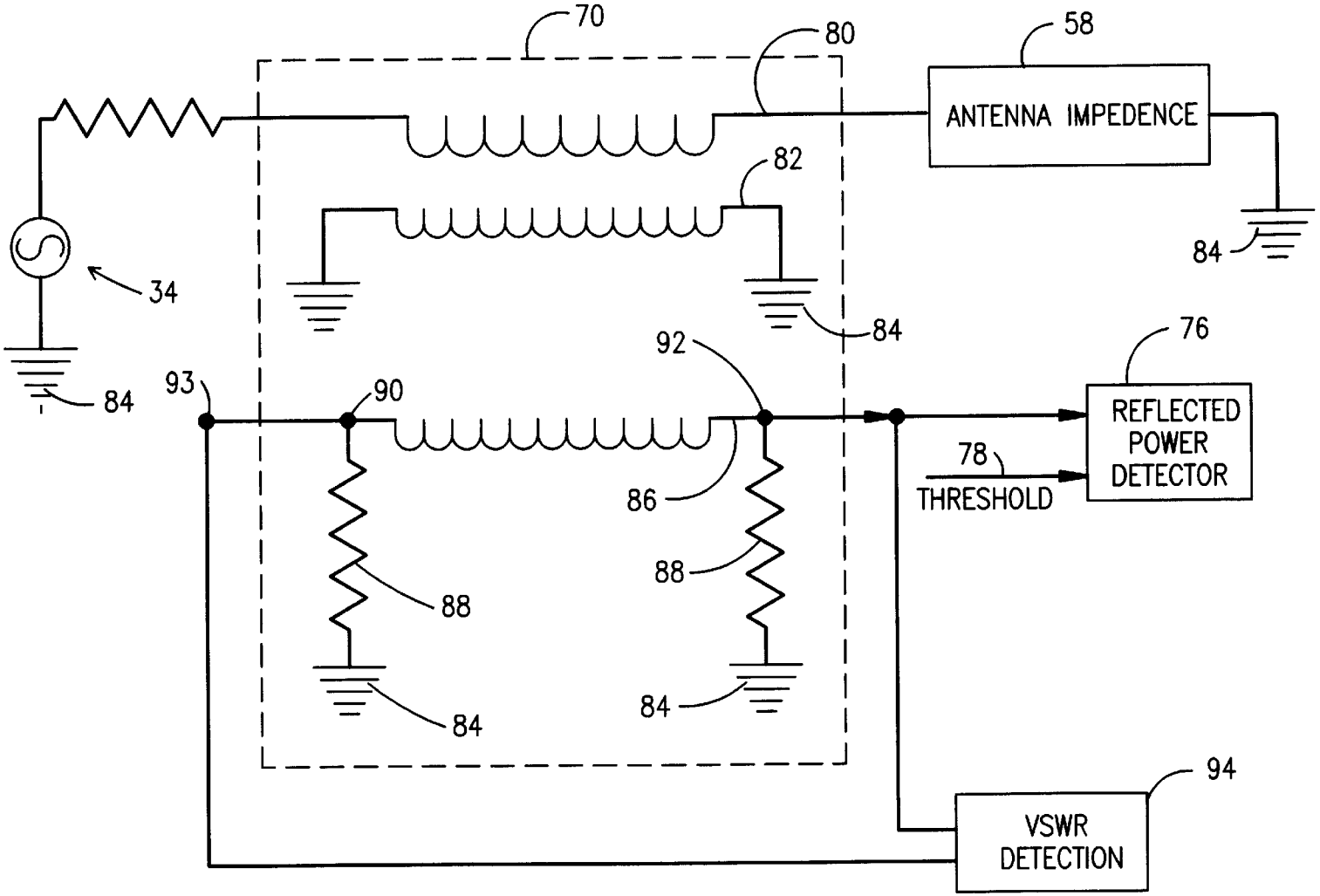
FIG. 4 is a schematic of the body worn bracelet circuitry.

The FIG. 4 schematic illustrates the improved body worn transmitter tamper detection circuit for the portable locating system. A directional coupler 70 is used to detect the reflected antenna 58 power or the ratio of power from the transmitter 34 to the reflected power from the antenna 58. In order for the ratio to be constant, the load impedance of the antenna 58 must remain constant. The portion of the power reflected from the antenna divided by the power sent from the antenna is known as the reflection coefficient.

The directional coupler 70 reflected port 92 is connected to a reflected power detector 76 that detects when the antennae reflected power is greater than a preset threshold 78 value. The directional coupler 70 reflected port 92 and the transmitter coupled port 90 are connected to an analog comparator 94 that detects changes in the reflection coefficient.

The reflected power 76 and VSWR detection circuit sensor 94 is based on a parallel transmission line directional coupler 70 consisting of three equal lengths of wire twisted together. The first transmission line 80 connects the transmitter 34 to the antenna 58. This transmission line will carry the voltage and current between the transmitter 34 and the antenna 58. This transmission line will have both the forward component from the transmitter 34 to the antenna 58 and the reflected component from the antenna 58 to the transmitter 34. The forward component of voltage and current are always in phase with each other, but the reflected components are always 180 degrees out of phase with each other. The second transmission line 82 is terminated at both ends to the radio frequency ground 84. The third transmission line 86 is terminated at both ends to radio frequency ground 84 through a resistor 88 at each end of the transmission line 86.

On the transmitter end of transmission line 86, a measure of transmitter coupling is possible before the voltage drop 90 across the resistor 88 to radio frequency ground 84. On the antenna end of transmission line 86, a measure of antenna reflected power is possible before the voltage drop 92 across the resistor 88 to radio frequency ground. A fraction of the forward and reflected voltage on the first transmission line 80 is coupled by capacitance to the third transmission line 86. A fraction of the forward and reflected current in the first transmission line 80 is coupled by inductance to the third transmission line 86 and develops a voltage across the terminating resistors 88.

The forward power can be measured at the couple port 90 resistor because the forward voltage and current are in phase with each other but the reflected voltage and current are 180 degrees out of phase and cancel.

The reflected power can be measured at the reflected port 92 resistor because the reflected voltage and current are in phase with each other but the forward voltage and current are 180 degrees out of phase and cancel.

Along the first transmission line 80 there will be locations where the forward and reflected voltage will be additive in phase and other locations where the forward and reflected voltage will be subtractive in phase. VSWR is the ratio of the peak additive voltage to the minimum subtractive voltage measured across the coupled port 90 and the reflected port 92.

Figure 5:
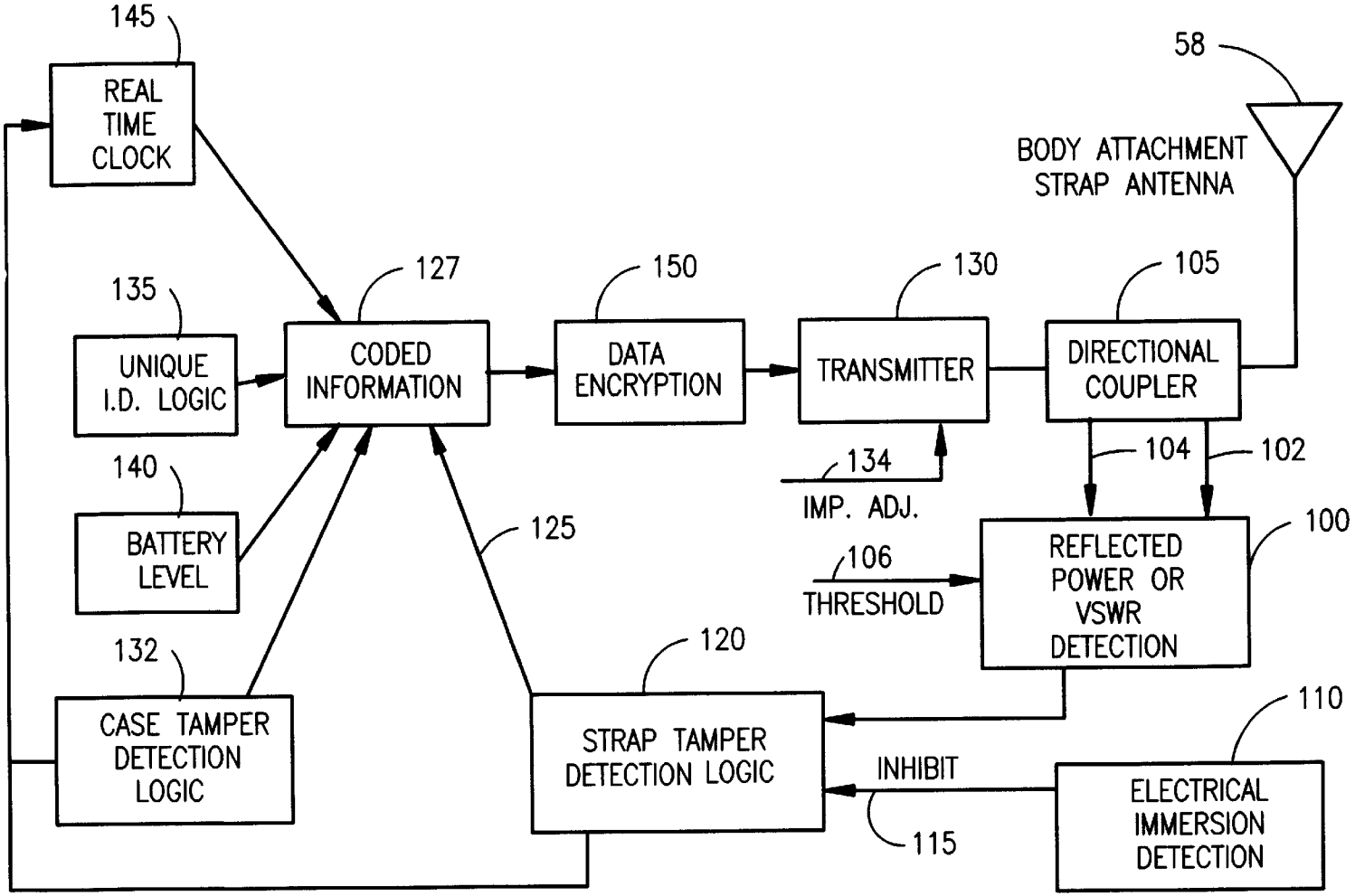
FIG. 5 is a block diagram describing the body worn transmitter incorporating data encryption to prevent tamper by spoofing, the strap antenna and a reflected power and VSWR tamper detection apparatus.

FIG. 5 illustrates the functional block diagram of the tamper detection for body worn transmitters of this invention. The reflected power detector 100 is an analog comparator that measures the reflected energy 102 sensed by the directional coupler 105 and compares it against a reference threshold 106 set at the desired reflected energy level when the antenna 58 is coupled to the body of the subject 12. The reflected power detector 100 can also be a VSWR detector by replacing the threshold voltage 106 with the voltage measured at the coupled port 104 of the directional coupler 105.

The electrolyte immersion detector 110 senses when the body worn transmitter housing 54, cover 68 and attachment strap antenna 58 (FIG. 3) are immersed in an electrolyte solution using an open continuity circuit completed by the electrolyte. A pin end 69 of the open continuity circuit is located on the case facing the body making it inaccessible to the wearer of the body worn transmitter 34. Since immersion of the attachment strap antenna 58 in an electrolyte will change the impedance of the attachment strap antenna 58 and its reflected energy, the immersion detector is needed to send an inhibit signal 115 to the strap tamper detection logic 120 to prevent a false tamper detection. The strap tamper detection logic 120 will not send the reset real time clock signal 147 to the real time clock 145. If the subject 12 cuts the attachment strap antenna 58 while immersed and removes the body worn transmitter, the body worn transmitter signal will no longer be received by the portable tracking device since the subject's body no longer performs as the antenna exposed above the electrolyte solution. The portable monitoring receiver 36 will report the lack of signal as a violation.

The body worn transmitter 34 sends strap tamper detection signal 125 as part of coded information 127 which is modulated on the transmitter's signal. In addition the strap tamper detection logic 120 will send a signal to reset the real time clock 145. The transmitter circuitry matches the attachment strap antenna 58 to an approximate 50 ohm impedance using an adjustment 134. The body worn transmitter strap tampering signal cannot be defeated by jumpering a cut attachment strap antenna 58 since the jumper will change the impedance of the antenna thereby changing the reflected energy. The strap tamper detection logic 120 cannot be bypassed inside the body worn transmitter housing 54 since the body worn transmitter 34 has case tamper detection 132 for an attempt to open the housing 54. The case tamper detection logic 132 also will send a reset signal 147 to the real time clock 145.

Other tamper defeating features of the body worn transmitter are an unique identification code 135 for each body worn transmitter, battery level reporting 140, a real-time clock 145 and data encryption 150.

The unique identification code 135 prevents mixing tamper detection reporting from multiple body worn transmitters in the reception area of the associated portable monitoring receiver. Body worn transmitter battery level reporting 140 prevents false tamper detection when the portable monitoring receiver can no longer receive the body worn transmitter signals due to a low battery condition.

The real-time clock 145 provides a public encryption key for data encryption 150. Data encryption 150 prevents the duplication of the body worn transmitter signals for the purpose of masking tamper detection codes. The real-time clock 145 allows any portable monitoring receiver to decrypt the encrypted data 150 transmitted by the body worn transmitter by using the constantly changing value of the real-time clock 145 as the public encryption key. The real-time clock is not encrypted so that the portable monitoring receiver can obtain the public encryption key. Since the encryption/decryption computation algorithm is internal to the body worn transmitter and the portable monitoring receiver, the public key cannot be used by a recording and retransmission apparatus to spoof the portable monitoring receiver.

The real-time clock 145 is reset to zero by the real-time clock signal 147 whenever tamper detection 120 and 132 is noted. The real-time clock value 145 of the body worn transmitter 34 is now different than the value that has been previously received in the portable monitoring receiver 36. This allows the portable monitoring receiver 36 to detect tamper if the strap or cover is replaced when the body worn transmitter is out of communication during tampering occurrence.

The portable monitoring receiver 36 can be directed to accept the new body worn transmitter clock value from the central monitoring station 42, thereby allowing a remote reset of the tamper detection latch caused by resetting the real-time clock 145 in the body worn transmitter 34.

The following Examples 1–8 demonstrate the measurable effects of altering the reflected power of the attachment strap antenna 52 by body fit, tamper and immersion. The voltage standing wave ratio (VSWR) data observations in each of these figures are collected from the parallel transmission line directional coupler 70. Each Example contains data from a Smith Chart with measured data points for multiple body worn transmitter frequencies.

EXAMPLE 1

| 1: Mkr | Frequency (MHz) | Ohm | Table of Measurements Ohm |
|---|---|---|---|
| 1: | 406.00 | 66.11 | −363.9 |
| 2: | 410.00 | 55.28 | −328.5 |
| 3: | 414.00 | 50.19 | −308.2 |
| 4: | 418.00 | 49.96 | −280.8 |
| 5: | 422.00 | 47.6 | −268.8 |
| 6: | 426.00 | 41.5 | −252 |
| 7: | 430.00 | 40.95 | −237.1 |
| 8: | 434.00 | 42.97 | −226.5 |

Figure 6A:
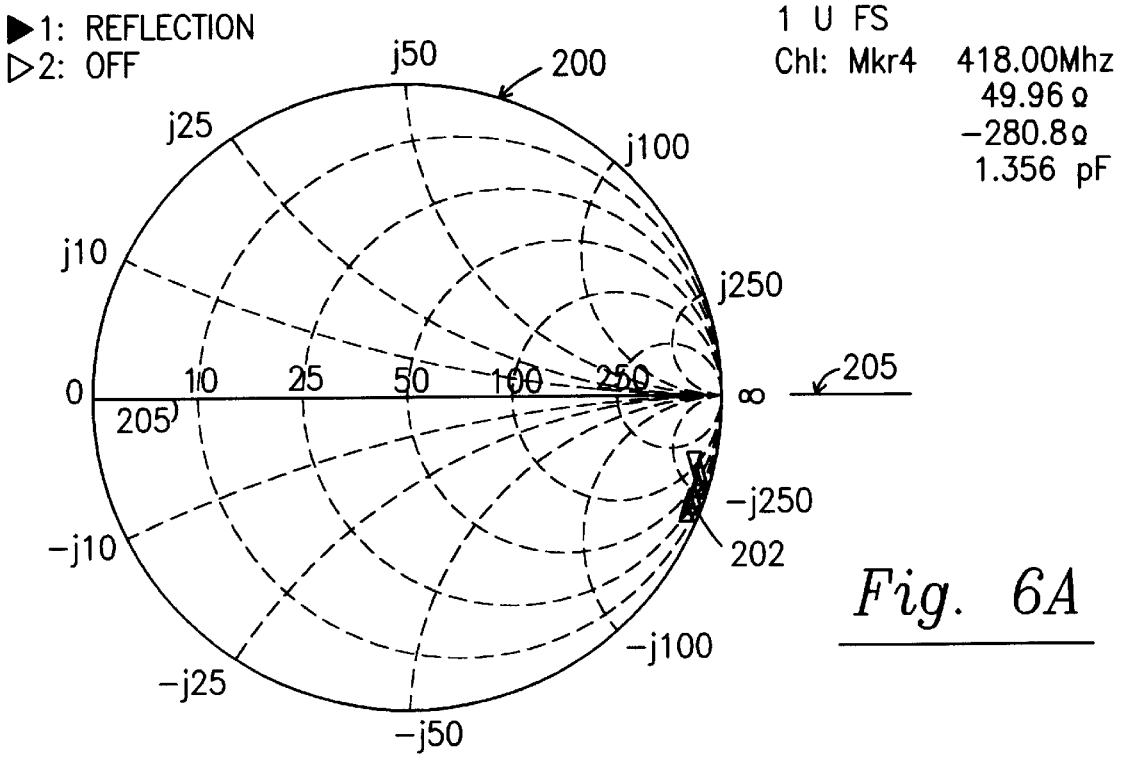
FIGS. 6A–6H are Smith Chart polar diagrams containing constant-resistance circles used to calculate data for Examples 1–8, respectively, in the specification.

In the data of Example 1 taken from the Smith Chart 200 in FIG. 6A, the horizontal axis 205 of the Smith Chart 200 represents normalized or constant resistance. In the measurements for the attachment strap antenna 52, the normal impedance is at 50 ohms when inductively coupled to the body of the subject. The left half of the Smith Chart is high impedance and the right side is low impedance. The top half of the Smith Chart is positive reactance and inductive. The bottom of the Smith Chart is negative reactance and capacitive.

FIG. 6A measurements were obtained from a connected (i.e., at both ends) 10 inch circumference attachment strap antenna 52 but not placed on the body of a subject. The data points 202 from the table of measurements at the indicated range of frequencies depict negative reactance, very high resistance and high impedance with the attachment strap antenna coupled to air.

EXAMPLE 2

| 1: Mkr | Frequency (MHz) | Ohm | Table of Measurements Ohm |
|---|---|---|---|
| 1: | 406.00 | 60.07 | −61.87 |
| 2: | 410.00 | 61.64 | −59.79 |
| 3: | 414.00 | 62.48 | −59.44 |
| 4: | 418.00 | 63.13 | −57.97 |
| 5: | 422.00 | 62.07 | −57.45 |
| 6: | 426.00 | 61.28 | −56.64 |
| 7: | 430.00 | 59.29 | −55.65 |
| 8: | 434.00 | 59.35 | −53.77 |

Figure 6B:
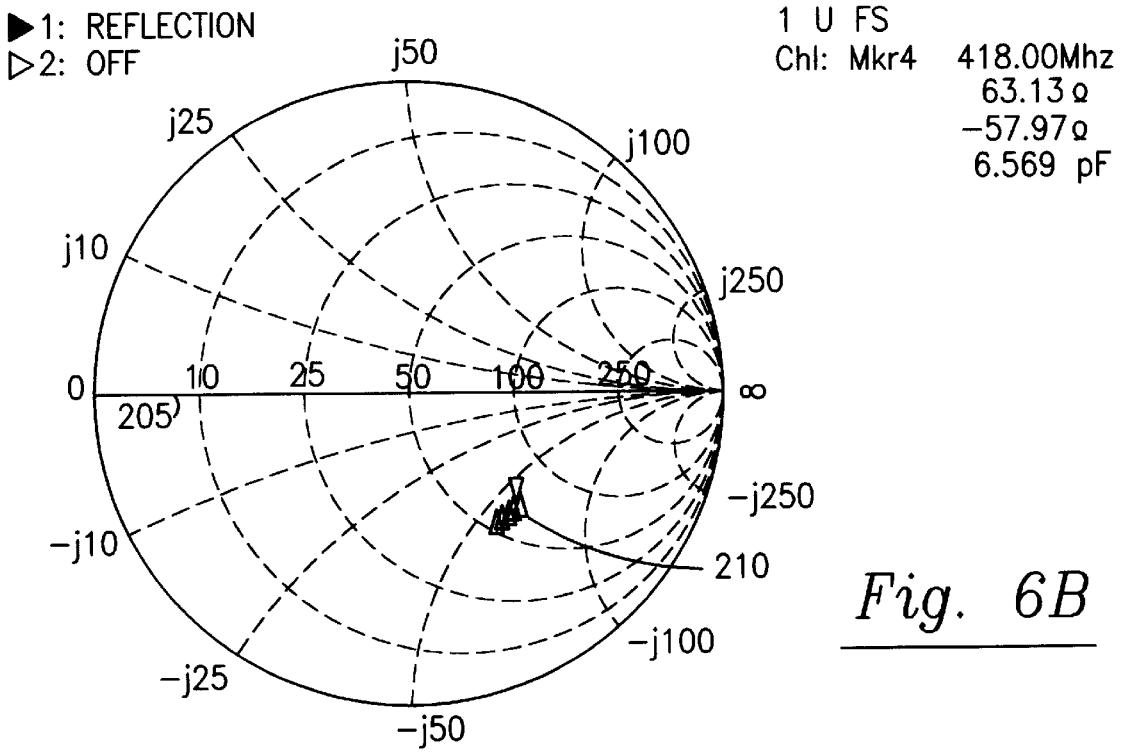

FIG. 6B measurements were obtained from a connected 10 inch circumference attachment strap antenna 52 placed loosely on the body of the subject. The data points 210 from the table of measurements depict a measurable reduction in resistance and a measurable increase in inductance. These observations demonstrate the capability for the body worn transmitter 34 to measure the VSWR difference between a functioning attachment strap antenna 52 coupled loosely to the body of a subject versus not being coupled to the body of a subject.

EXAMPLE 3

| 1: Mkr | Frequency (MHz) | Ohm | Table of Measurements Ohm |
|---|---|---|---|
| 1: | 406.00 | 51.68 | 3.215 |
| 2: | 410.00 | 52.56 | 3.668 |
| 3: | 414.00 | 53.64 | 4.043 |
| 4: | 418.00 | 54.68 | 4.353 |
| 5: | 422.00 | 55.78 | 4.565 |
| 6: | 426.00 | 56.97 | 4.746 |
| 7: | 430.00 | 58.19 | 4.655 |
| 8: | 434.00 | 59.39 | 4.628 |

Figure 6C:
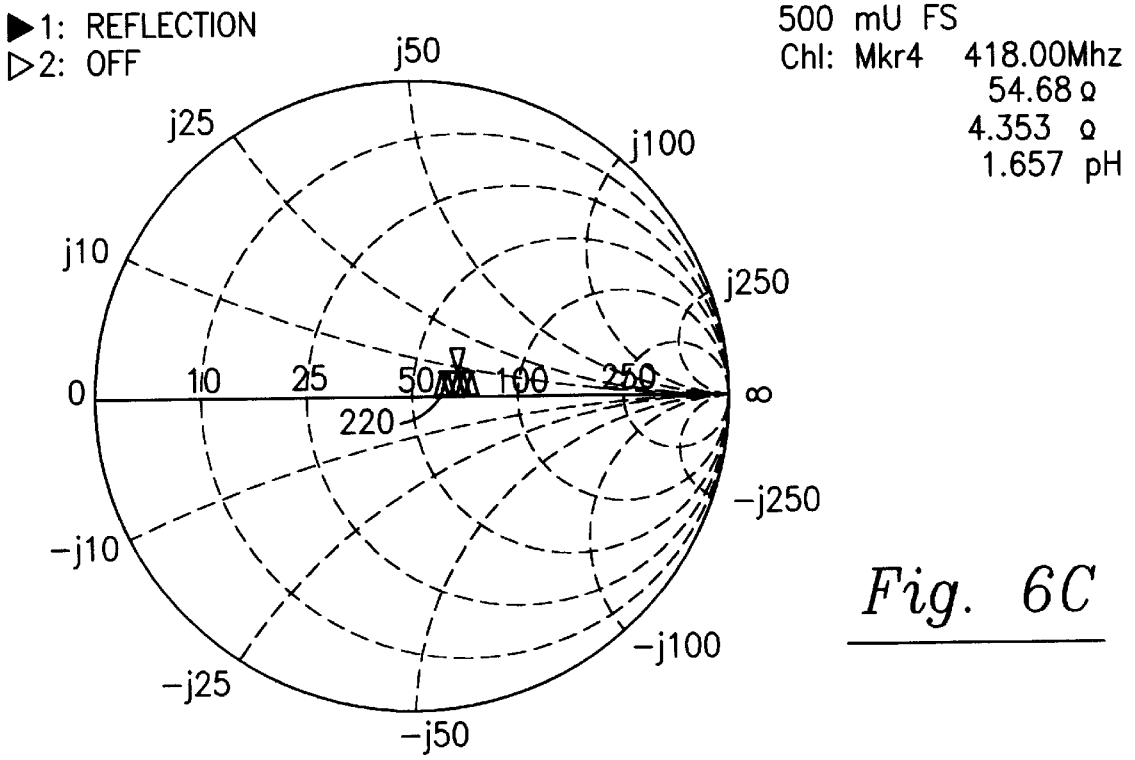

FIG. 6C measurements were obtained from a connected 10 inch circumference attachment strap antenna 52 placed closely to the body of the subject. The data points 220 from the table of measurements depict a measurable reduction in resistance, an increase in inductance and a transition to neutral reactance. These observations form a measurable trend from no coupling to loose coupling to close coupling to the subject's body.

EXAMPLE 4

| 1: Mkr | Frequency MHz | Ohm | Table of Measurements Ohm |
|---|---|---|---|
| 1: | 406.00 | 32.23 | −56.36 |
| 2: | 410.00 | 32.72 | −55.11 |
| 3: | 414.00 | 31.92 | −53.84 |
| 4: | 418.00 | 31.76 | −52.81 |
| 5 | 422.00 | 31.34 | −51.49 |
| 6: | 426.00 | 31 | −50.27 |
| 7: | 430.00 | 30.72 | −48.59 |
| 8: | 434.00 | 30.91 | −48.08 |

Figure 6D:
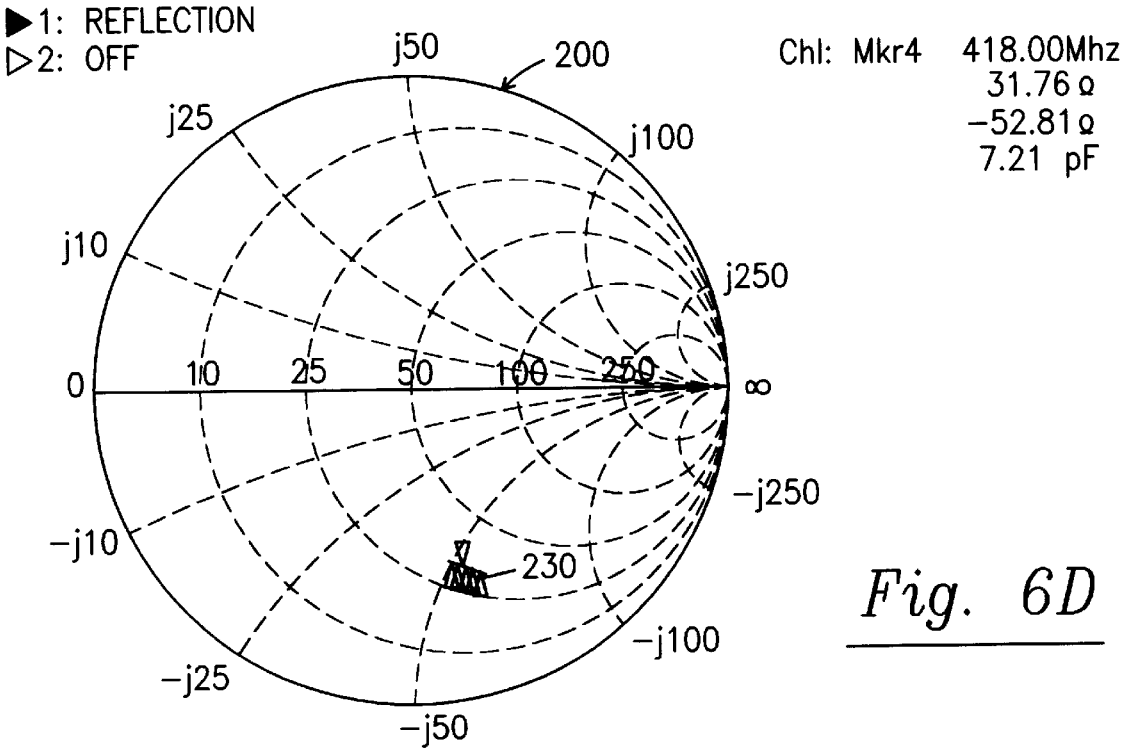

FIG. 6D measurements were obtained from a fourteen inch circumference strap antenna 52 simulating an ideal severed attachment strap antenna 52 with a conductive jumper placed loosely on the subject's body. The data points 230 from the table of measurements depict a measurable difference in reactance, inductance and resistance to the data in FIG. 6B where the attachment strap antenna was placed loosely on the subject's body. These observations demonstrate the capability to detect the attachment strap antenna being jumpered and severed while still being loosely coupled to the subject's body.

EXAMPLE 5

| 1. Mkr | Frequency MHz | Ohm | Table of Measurements Ohm |
|---|---|---|---|
| 1: | 406.00 | 40.88 | −205.2 |
| 2: | 410.00 | 36.11 | −197.3 |
| 3: | 414.00 | 33.96 | −190.4 |
| 4: | 418.00 | 32.65 | −186.4 |
| 5: | 422.00 | 27.95 | −176.2 |
| 6: | 426.00 | 25.28 | −171.9 |
| 7: | 430.00 | 26.13 | −164.8 |
| 8: | 434.00 | 24.78 | −160.2 |

Figure 6E:
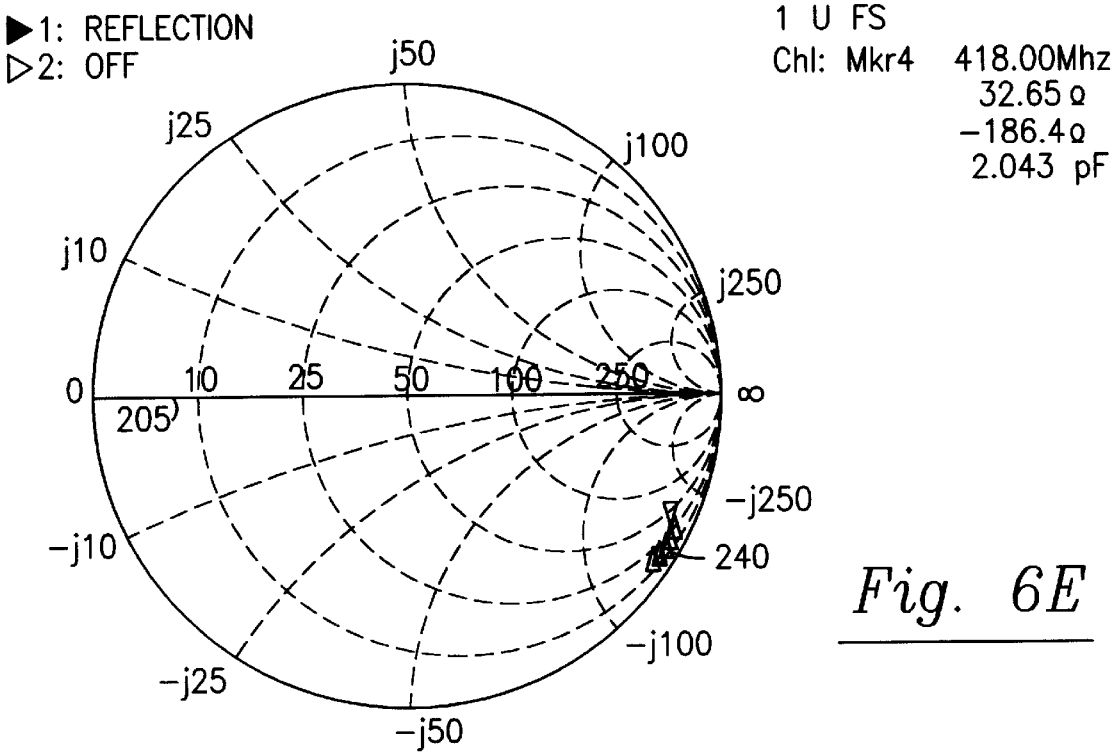

FIG. 6E measurements wee obtained from a connected 14 inch circumference attachment strap antenna but not placed on the body of the subject. The data points 240 from the table of measurements depict that the reflected power characteristics (i.e., reactance and inductance) of a 14 inch and a 10 inch circumference antenna are similar, thereby making the measurements independent of the length of the attachment strap antenna.

EXAMPLE 6

| 1. Mkr | Frequency MHz | Ohm | Table of Measurements Ohm |
|---|---|---|---|
| 1: | 406.00 | 7.682 | 12.86 |
| 2: | 410.00 | 7.508 | 12.55 |
| 3: | 414.00 | 7.66 | 12.88 |
| 4: | 418.00 | 7.847 | 12.9 |
| 5: | 422.00 | 8.035 | 13.3 |
| 6: | 426.00 | 8.045 | 12.8 |
| 7: | 430.00 | 8.249 | 13.49 |
| 8: | 434.00 | 8.384 | 13.19 |

Figure 6F:
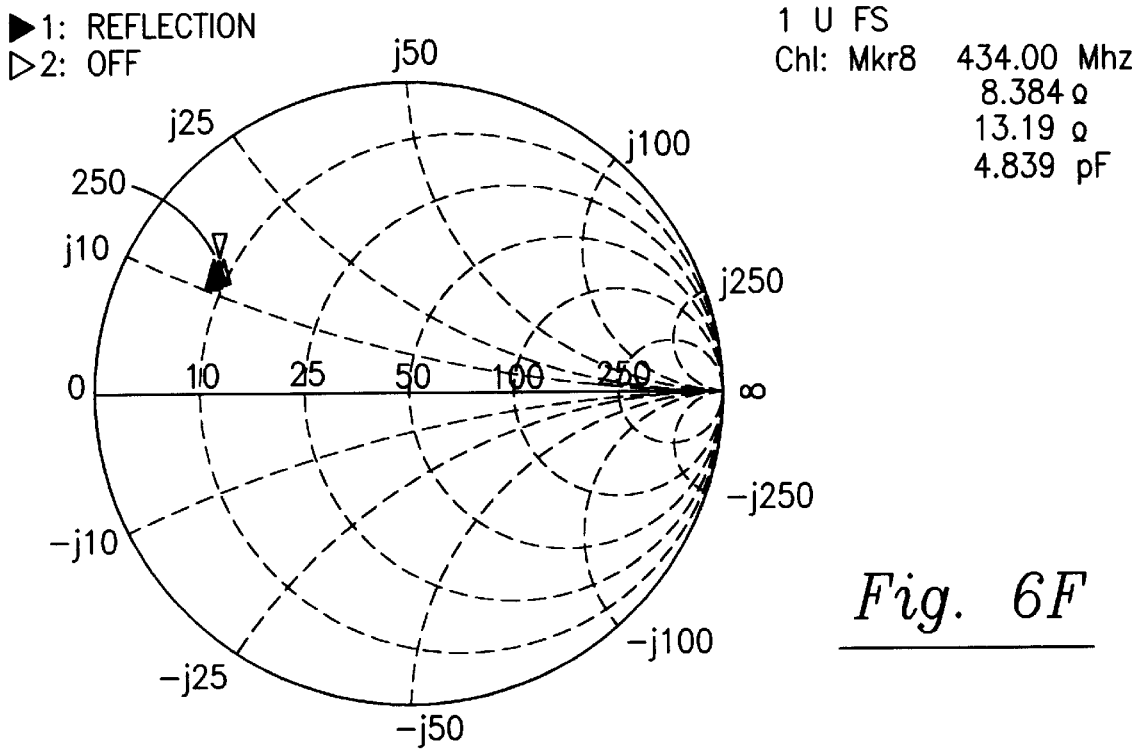

FIG. 6F measurements were obtained from a connected 10 inch circumference attachment strap antenna immersed in salt water (strong electrolytic solution) but not placed on the body of the subject. The data points 250 from the table of measurements depict a measurable transition from negative to positive reactance and a lower impedance value than all other tests with the attachment strap antenna not immersed in an electrolyte. These observations demonstrate the capability to detect when the attachment strap antenna is immersed in a strong electrolyte solution.

EXAMPLE 7

| 1. Mkr | Frequency MHz | Ohm | Table of Measurements Ohm |
|---|---|---|---|
| 1: | 406.00 | 2.553 | 9.756 |
| 2: | 410.00 | 2.615 | 9.52 |
| 3: | 414.00 | 2.679 | 10.49 |
| 4: | 418.00 | 2.628 | 10.08 |
| 5: | 422.00 | 2.82 | 11 |
| 6: | 426.00 | 2.73 | 11.31 |
| 7: | 430.00 | 2.901 | 11.97 |
| 8: | 434.00 | 3.246 | 12.25 |

Figure 6G:
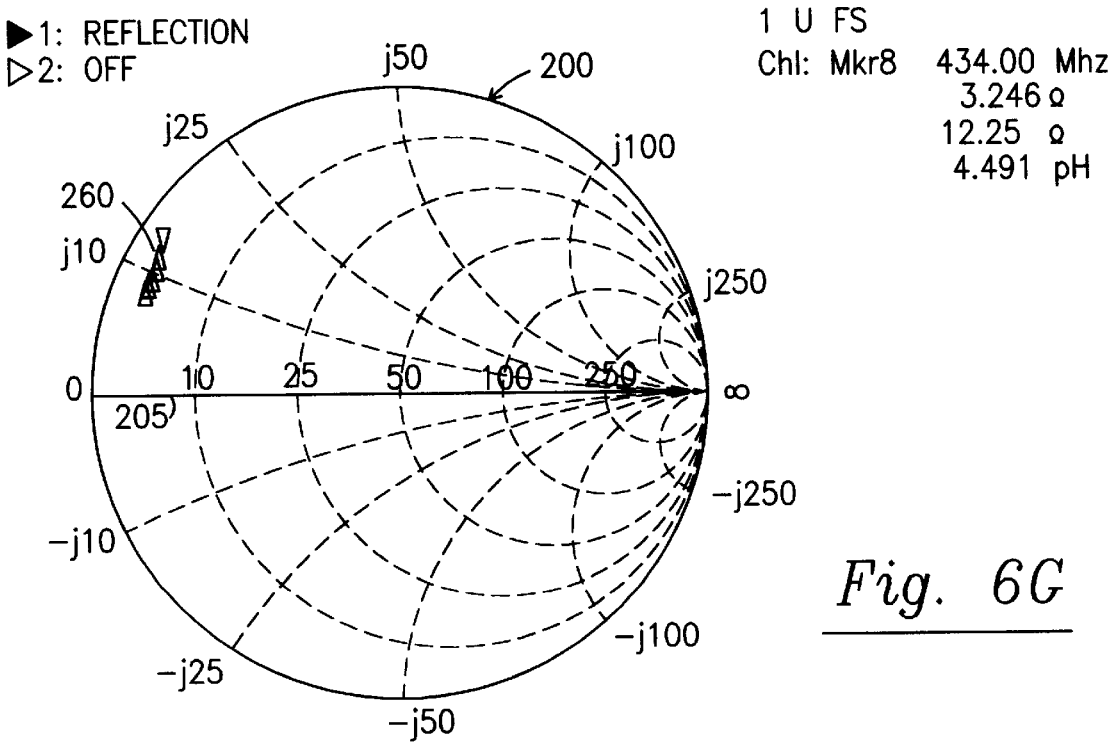

FIG. 6G measurements were obtained from a connected 10 inch circumference attachment strap antenna immersed in tap water (weak electrolytic solution) but not placed on the body of the subject. The data points 260 from the table of measurements establishes that immersion of the attachment strap antenna in a weak electrolytic solution has similar results to immersion in a strong electrolytic solution from FIG. 6F.

EXAMPLE 8

| 1. Mkr | Frequency MHz | Ohm | Table of Measurements Ohm |
|---|---|---|---|
| 1: | 406.00 | 4.135 | 8.922 |
| 2: | 410.00 | 4.349 | 8.947 |
| 3. | 414.00 | 4.325 | 9.607 |
| 4: | 418.00 | 4.489 | 9.416 |
| 5: | 422.00 | 4.599 | 10.02 |
| 6: | 426.00 | 4.568 | 9.861 |

-continued

| 1. Mkr | Frequency MHz | Ohm | Table of Measurements Ohm |
|---|---|---|---|
| 7: | 430.00 | 4.455 | 10.6 |
| 8: | 434.00 | 4.388 | 10.55 |

Figure 6H:
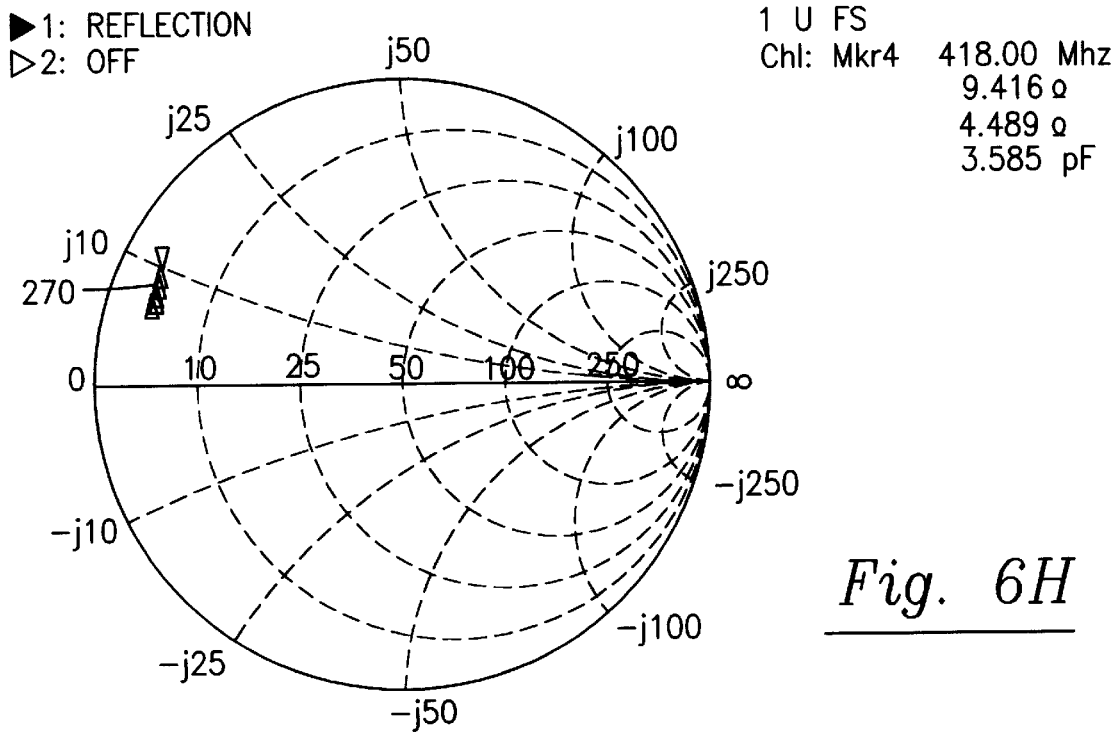

FIG. 6H measurements were obtained from a connected 10 inch circumference attachment strap antenna immersed in tap water (weak electrolytic solution) coupled closely to the body of the subject. The data points 270 from the table of measurements depict that the immersion of the attachment strap antenna has similar results to immersion with the attachment strap antenna not placed on the body of the subject.

Equivalent elements can be substituted for the ones set forth in the above to achieve the same results in the same manner.

We claim:

1. A tamper detection system for a body worn transmitter attached to a subject's body comprising:

a portable monitoring receiver in proximity to the body worn transmitter continuously receiving signals from the body worn transmitter and a global positioning satellite;

the body worn transmitter having an antenna imbedded in a strap for communicating with the portable monitoring receiver, the antenna inductively coupled to the body of the subject and means for electrically coupling the antenna to the transmitter;

the body worn transmitter having programmed therein a coded identification signal, a data encryption for the coded identification signal, a real time clock and means to detect tampering with the body worn transmitter; and the body worn transmitter additionally containing an electrolyte immersion sensor sending a tamper inhibit signal via the antenna to the portable monitoring receiver and then to a base station.

2. The tamper detection system according to claim 1 wherein the body worn transmitter emits a battery level signal.

3. A tamper detection system according to claim 1 wherein the body worn transmitter emits a real time clock data signal.

4. A tamper detection system according to claim 1 wherein the antenna has a conductive corrosion resistant metal foil core and a resistive coating to prevent direct electrical contact with the subject's body.

5. A tamper detection system according to claim 1 wherein the means for electrically coupling the antenna to the transmitter is a strap clamp.

6. A tamper detection system according to claim 1 wherein the means to detect tampering with the transmitter is an antenna reflected power sensor and level detector, an antenna voltage standing wave ratio sensor and change detector and a transmitter cover pressure sensitive switch.

7. A tamper detection system according to claim 6 wherein the detection of a tamper is noted by the base station and the body worn transmitter is reset by a signal from the base station.

8. A tamper detection system according to claim 1 having a data encryption system located between the body worn transmitter and the portable monitoring receiver, the encryption system using the real-time clock as a public data encryption key.

9. A tamper detection device in a body worn transmitter attached to a subject's body and adapted to continuously send electrical signals to a nearby portable monitoring receiver, the body worn transmitter comprising:

an antenna imbedded in a strap for communicating with the portable monitoring receiver, the antenna inductively coupled to the body of the subject and a means for electrically coupling the antenna to the transmitter;

the body worn transmitter having programmed therein a coded identification signal, a data encryption for the coded identification signal, a real time clock and means to detect tampering with the body worn transmitter; and the body worn transmitter additionally containing an electrolyte immersion sensor which sends a tamper inhibit signal to a tamper detection circuit in the body worn transmitter.

10. The tamper detection device in a body worn transmitter according to claim 9 wherein the body worn transmitter antenna has a conductive corrosion resistant metal foil core and a resistive coating to prevent direct electrical contact with the subject's body.

11. The tamper detection device in a body worn transmitter according to claim 9 wherein the means for electrically coupling the antenna to the transmitter is a strap clamp.

12. The tamper detection device in a body worn transmitter according to claim 9 wherein the means to detect tampering with the transmitter are an antenna reflected power sensor and level detector, an antenna voltage standing wave ratio sensor and charge detector and a transmitter cover pressure sensitive switch.

13. The tamper detection device on a body worn transmitter according to claim 9 wherein the body worn transmitter has a housing with a base proximal to the subject, the base containing a false strap tamper detection sensor.

14. A tamper detection device in a body worn transmitter according to claim 9 wherein the real time clock provides a remote means to reset the tamper detection latch.

15. A tamper detection system for a body worn transmitter strapped to a subject's body appendage comprising:

a portable monitoring receiver in proximity to the body worn transmitter continuously receiving signals from the body worn transmitter and a global positioning satellite; and the body worn transmitter having an antenna imbedded in a strap for communicating with the portable monitoring receiver, the antenna inductively coupled to the body of the subject and a strap clamp electrically coupling the antenna to the transmitter;

the body worn transmitter having programmed therein a coded identification signal, a data encryption for the coded identification signal, a real time clock emitting a real-time clock data signal and an antenna reflected power sensor and level detector, an antenna voltage standing wave ratio sensor and charge detector and a transmitter cover pressure sensitive switch to detect tampering with the body worn transmitter.

16. The tamper detection system according to claim 15 wherein the body worn transmitter additionally contains an electrolytic immersion sensor sending a tamper inhibit signal to a tamper detection circuit in the body worn transmitter.

17. The tamper detection system according to claim 16 wherein the antenna has a conductive corrosion resistant metal foil core and a resistive coating to prevent direct electrical contact with the subject's appendage.

* * * * *